US005591248A

United States Patent [19]

Jåfs et al.

[11] Patent Number: 5,591,248

[45] Date of Patent: Jan. 7, 1997

[54] METHOD FOR MELTING METAL, ESPECIALLY NON-FERROUS METAL

[75] Inventors: Lars H. M. Jåfs; Daniel Jåfs, both of Helsingfors, Finland

[73] Assignee: AB Jafs Export Oy Holimesy, Finland

[21] Appl. No.: 230,120

[22] Filed: Apr. 20, 1994

[30] Foreign Application Priority Data

Apr. 20, 1993 [FI] Finland ..... 931786

[51] Int. Cl.[6] ..... C22B 9/16

[52] U.S. Cl. ..... 75/414; 75/585

[58] Field of Search ..... 75/585, 10.23, 75/414, 686, 687; 266/208; 373/16

[56] References Cited

U.S. PATENT DOCUMENTS

| | | | |
|---|---|---|---|
| 3,764,297 | 10/1973 | Coad | 75/10.23 |
| 3,935,003 | 1/1976 | Steinke et al. | 75/687 |
| 5,477,907 | 12/1995 | Meyer et al. | 266/239 |

*Primary Examiner*—Melvyn Andrews
*Attorney, Agent, or Firm*—Klarquist Sparkman Campbell Leigh & Whinston

[57] ABSTRACT

The invention relates to a method and a device for melting or processing metal. The metal material is batched into a chamber (1) and circulated from one chamber to another (3, 5, 10, 11, 15, 18) with simultaneous melting under the effect of thermal radiation from the chamber lids. One or more pumps act on the pressure above the molten metal in one or more pump chambers (10, 11), connected with a melt chamber (5) and with a splash chamber (18, 15), from where the melt is discharged or recycled. The object of the invention is to upgrade melt quality by reducing turbulence in the melt chambers. This object has been achieved by transferring, at an increased pressure in the pump chamber, a substantially greater amount, approx. three to fifteen times more melt per time unit from each pump chamber (10, 11) to the splash chamber (18, 15) than from the same pump chamber to the splash chamber (5). This arrangement has been implemented in a device in which the ratio between the cross-sectional surfaces of the ducts (12, 17; 13, 14) between a pump chamber (10; 11) and the preceding melt chamber (5) or the same pump chamber (10; 11) and the consecutive splash chamber (18; 15) is in the range from 3:1 to 15:1, preferably from 5:1 to 10:1.

6 Claims, 1 Drawing Sheet

METHOD FOR MELTING METAL, ESPECIALLY NON-FERROUS METAL

Figure 1:
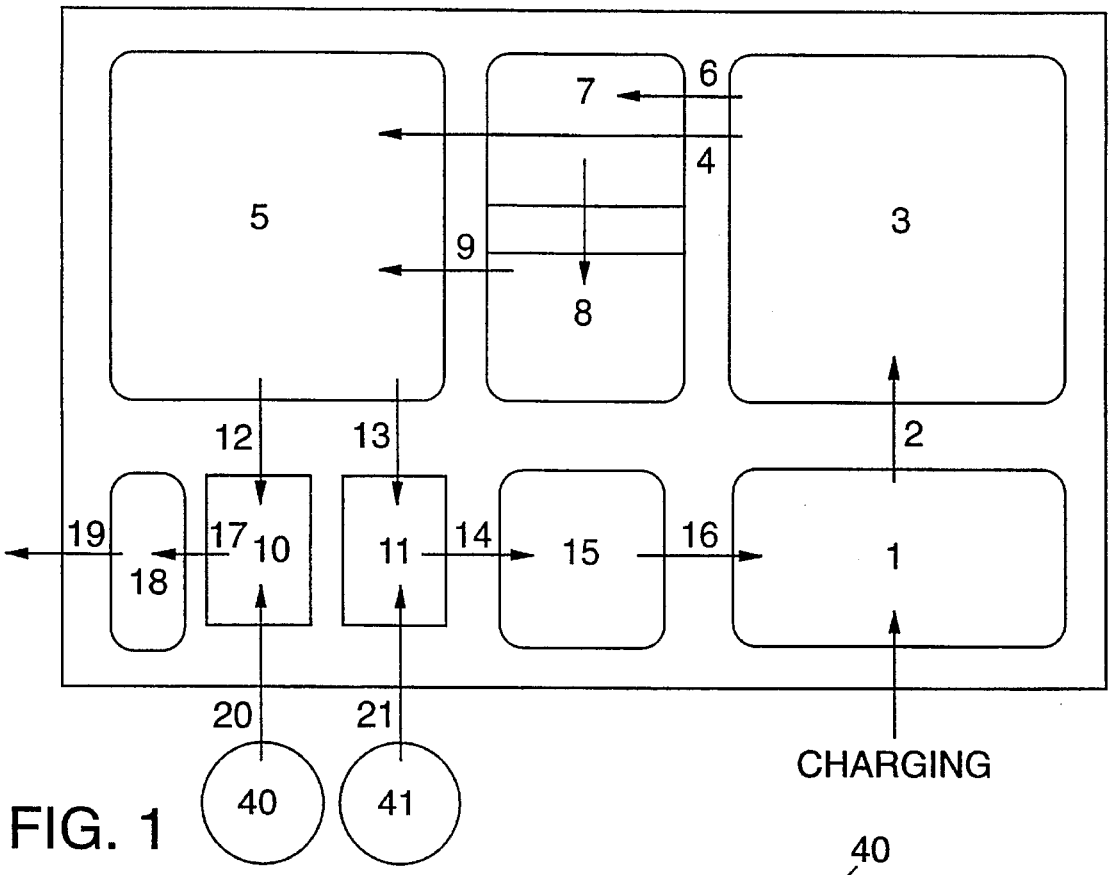

The invention relates to a method and a device for melting metal and to furnaces for processing molten metal, especially non-ferrous metal.

The purpose of the invention is to achieve a method for melting and for processing molten non-ferrous metal, yielding a better melt quality than equivalent, previously known methods. The melting of metal in melting furnaces comprising circulation and batching of the metal by means of pneumatic pumps is previously known, cf. for instance SE patent specification 437 339. Degasification of the metal e.g. by means of nitrogen gas, optionally combined with filtration, to enhance melt quality, is also previously known.

According to the present invention, the quality is further enhanced by reducing turbulence in the chambers.

Thus, the innovation of the melting process in a melting furnace, and in the processing of molten metal in a furnace, respectively, consists in that the amount of molten metal pressed into the splash chamber from increased pressure in the space above the molten surface in the pump chamber is substantially greater than the amount of molten metal simultaneously pressed back into the melting chamber connected with the pump chamber. Moreover, provisions are taken to prevent the melt flow transferred from the bottom of the pump chamber to the splash chamber. At the same time, there are provisions to prevent the melt flow transferred from tile pump chamber bottom to the splash chamber from returning to the duct and hitting the melt in the pump chamber, at the event of a sudden drop of pressure in the pumping chamber. These provisions avoid turbulence and increase melt quality. The duct between the pump chamber bottom and the splash chamber is preferably oblique upwards, so that melt is discharged near tile upper end of tile splash chamber, slightly above the melt level.

Pressure increase above the melt in the pump chamber is achieved by means of a pressure increase in the inert gas, appropriately nitrogen, filling the space above the melt and communicating with the upmost space above a pump piston in the pump cylinder connected with the pump chamber. The pressure increase and decrease are controlled to avoid that a vacuum is generated.

The level of the furnace and the outlet pipe is preferably adjusted so as to allow minimum level variations. In continuous consumption, the batching must also be continuous and adapted to consumption.

The device is basically a conventional melting furnace or a furnace having preferably at least two melt chambers, two pump chambers and two splash chambers. According to the invention, the cross-sectional area of the duct between a pump chamber and the associated splash chamber is essentially greater than the cross-sectional area of the duct between the same pump chamber and the preceding melt chamber. The ratio between these cross-sectional areas is in the range from 15:1 to 3:1, preferably from 10:1 to 5:1, a ratio of 8:1 being particularly appropriate.

The pump cylinders circulating the molten metal in the melting furnace are vertically arranged pump cylinders divided by a horizontal, solid partition into an upper and a lower pump space. A pump shaft is fitted movably through the partition and the pump shaft is provided with a pump piston at either end. The partition appropriately divides the cylinder space into two equal parts.

The space above the upper pump piston communicates over a pipe with the space above the molten metal in the pump chamber connected with the pump. The communicating spaces are appropriately filled with an inert gas, preferably nitrogen. To achieve a controlled increase and decrease of the pressure in the pump chamber above the melt, the communicating space above the upper pump piston is provided with a manometer and a valve leading to a gas source, appropriately a nitrogen source.

The space between the horizontal wall of the pump cylinder and the upper pump piston and also the space between the horizontal wall and the lower pump piston are adjustably connected to a respective compressed air source, whereas the space below the lower pump piston communicates with the surrounding atmosphere. A pump cylinder equipped in this manner makes it possible to increase and to decrease the pressure in the space above the melt in the pump chamber, and thus the melt is smoothly transferred to the splash chamber, and the melt remaining in the duct is allowed to return smoothly to the pump chamber. Without controlled pressure conditions, underpressure may arise in the pump chamber under the effect of the reverse motion of the pump piston, resulting in a sudden return flow and impact against the melt in the pump chamber. The turbulence which would then arise would affect the melt quality considerably.

Figure 2:
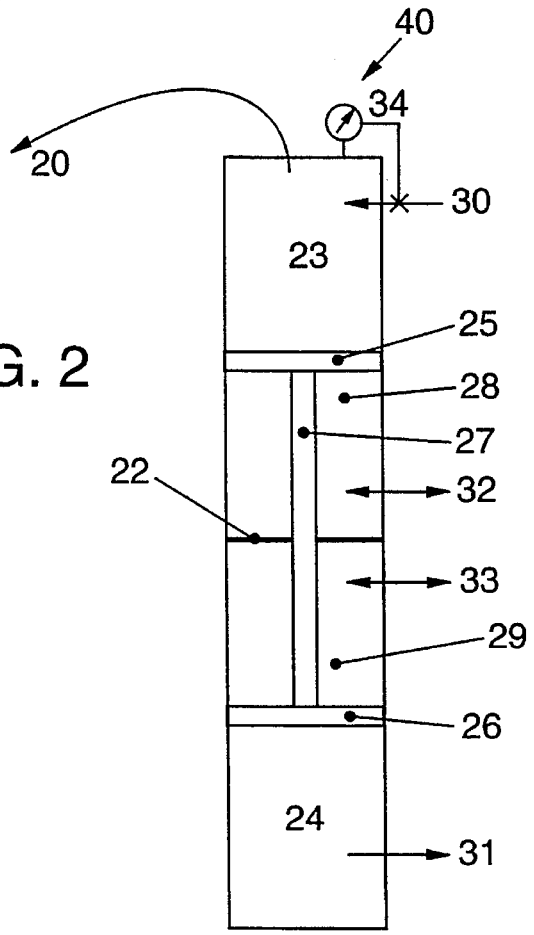

A preferred embodiment example of the melting of metal and of a melting furnace according to the invention will be described below with reference to the enclosed drawings, in which FIG. 1 is a schematic view of a melting furnace according to the invention seen from above with the covers removed, and with the associated pump cylinders shown, and FIG. 2 shows the cross-section of a vertical pump cylinder with the connection to the pump chamber in the melting furnace schematically drawn.

The melting furnace is divided into several separate chambers by means of partitions equipped with openings, through which the chambers communicate with each other. The heat for melting the metal derives from the electrically heated cover of the melting furnace, which is not shown in the figures. Ingots and/or scrap metal are batched alter preheating into the inlet chamber 1, from where the molten metal flows through an opening near the bottom to the first melt chamber 3. The opening is not shown, but the flow transfer through the opening is indicated with an arrow 2. From the melt chamber 3 the metal flows through an opening near the bottom, marked with the arrow 4, to the following melt chamber 5. Between the melt chambers 3 and 5, the melt can be degasified and/or filtrated in order to enhance the melt quality. In that case, the melt flows from the first melt chamber 3 through an opening indicated with the arrow 6 to degasification and filter chambers 7 and 8, and from there on through an opening, arrow 9, to the second melt chamber 5. The degasification and filtering chambers 7 and 8 have a greater depth than the melt chambers in order to make reverse flow possible.

The melt chamber 5 communicates with two pump chambers 10 and 11 through two ducts marked with arrows 12 and 13. The opening of the ducts to the melt chamber 5 is located near the bottom of the melt chamber and their openings to the pump chambers 10 and 11 are located near the bottom of their respective pump chamber. From the pump chamber 11, molten metal is pressed through a duct, marked with the arrow 14, and having a greater cross-section than the duct 13, to the splash chamber 15. The opening of the duct 14 in the pump chamber 11 is located near the bottom of the pump chamber and its opening in the splash chamber 15 near the top of the splash chamber. The ratio between the cross-sectional area of the ducts 14 to the duct 13 is preferably 8:1, but may vary in the range from 10:1 to 5:1, even from 15:1 to 3:1. Owing to friction against the pipe walls, the volume amount of melt per time unit does not vary with the same ratio as the cross-sectional areas. The friction action on the flow increases in inverse proportion to the cross-sectional area. A still higher ratio entails oxidation, and a still lower ratio results in malfunction or non-function of the system. From the splash chamber 15 the molten metal flows through an opening near the bottom, arrow 16, to the inlet chamber 1, where it joins ingots and scrap metal batched into the furnace.

Meanwhile, a controlled amount of molten metal is pressed correspondingly through a duct 17 to a splash chamber 18, from where it is discharged for consumption through an electrically heated pipe 19.

Both the circulating and the pumping out of molten metal is accomplished by supplying an inert gas, for instance nitrogen, under control to the respective pump chamber (10, 11) through an inlet duct 20 and 21 in the pump chamber lid from an external, vertically positioned pump cylinder 40 and 41. The two pump cylinders are identical, and control their respective pump chambers in an identical manner. The pump cylinder, cf. FIG. 2, has a horizontal partition 22 dividing the cylinder into two, preferably equal spaces 23 and 24. On either side of the horizontal wall 22 a piston 25 and 26 is provided, which are firmly connected with a piston arm 27 passing through the partition 22. The space between the partition 22 and the upper pump piston 25 is marked with reference 28 and the space between the partition and the lower pump piston with 29. An inert gas, preferably nitrogen gas, fills up the upper cylinder space 23 and the space above the molten metal in the pump chamber 10 and 11, communicating with the space 23 through the pipe 20 and 21. The pump cylinder space 23 is provided with a valve 30 leading to a nitrogen gas source and a manometer 31. Pumping and thus circulation of molten metal is achieved by allowing compressed air to flow into the cylinder space 28 through a pneumatic valve, marked with two-way arrow 32. In this situation, the cylinder pistons 25 and 26 are pressed upwards, overpressure being generated above the metal surface in the pump chamber 10, 11. A specific greater amount of molten metal is then pressed through the ducts 17 and 14 to the splash chamber 18 and 15, whereas a specific smaller amount is pressed back to the melt chamber 5 through the opening 12 and 13. After a certain period of time the air pressure in the space 28 is allowed to drop, whereas the pressure in the space 29 is raised so as to make the cylinder pistons 25 and 26 move downwards. The nitrogen gas in the upmost space in the space 23 of the pump expands, the manometer 34 being set to control the valve 30 to let more nitrogen gas through if the pressure in the space 23 drops below a given minimum limit. The lower cylinder space 24 contains air and communicates with the surrounding atmosphere through a pipe 31. In this manner, the pressure above the melt surface in the pump chamber 10,11 is also maintained above the specific limit and no underpressure will arise. This arrangement results in smooth and controlled pressing of molten metal into the splash chamber, avoiding a sudden return flow hitting the molten metal.

The pumping through the pump chambers 10 and 11 produces a circulation through the melt chambers so that ingots and metal scrap join the molten metal in the inlet chamber 1, resulting in rapid and efficient melting, molten metal being pumped out from the splash chamber 18 through the duct 19 to be consumed.

All the covers of the melting furnace, especially the pump chamber lid, must be tightly sealed. The melting furnace and pipe levels are preferably adjusted so as to allow minimum level variation.

We claim:

1. A method for melting and processing in a melting furnace metal which comprises a sealed inlet chamber for receiving solid metal material and having means for heating said solid metal to a molten state;

a sealed melt chamber connected to receive molten metal from said inlet chamber and having means for further heating molten metal contained therein, a first pump and a second pump and means connecting each of said pumps to said melt chamber to permit molten metal to flow between said melt chamber and each of said pumps, each of said pumps comprising a sealed pump chamber for receiving molten metal from said melt chamber, a first sealed splash chamber connected to receive molten metal from said first pump, a second splash chamber connected to receive molten metal from said second pump and having a discharge opening for discharging therefrom molten metal pumped into said second splash chamber, said first splash chamber being connected to said inlet chamber so as to permit the flow of molten metal from said first splash chamber to said inlet chamber, said method comprising the steps of feeding solid metal to said inlet chamber, transferring molten metal from said inlet chamber to said melt chamber, transferring molten metal from said melt chamber to each of said pumps, thereafter transferring molten metal from each of said pumps to the splash chamber connected thereto at a first rate and simultaneously transferring molten metal from said pumps back to the melt chamber at a second rate, said first rate being approximately three to approximately fifteen times higher than said second rate.

2. A method according to claim 1 wherein said first rate is between approximately five to approximately ten times higher than said second rate.

3. A method according to claim 1, further including the step of establishing a gaseous atmosphere over the molten metal therein in each of said pump chambers to transfer the molten metal therefrom.

4. A method according to claim 1 wherein said atmosphere comprises an inert gas.

5. A method according to claim 3 wherein said gas is nitrogen.

6. A method according to claim 1, including the step of controlling the pressure in the said chamber of each of said pumps to maintain a positive pressure in each of said pump chambers.

* * * * *

UNITED STATES PATENT AND TRADEMARK OFFICE

CERTIFICATE OF CORRECTION

PATENT NO. : 5,591,248

DATED : January 7, 1997

INVENTOR(S) : Lars H.M. Jåfs and Daniel Jåfs

It is certified that error appears in the above-identified patent and that said Letters Patent is hereby corrected as shown below:

Column 1, line 28, "from tile pump" should read –from the pump--;

Column 2, line 37, "batched alter" should read –batched after--;

Column 3, line 43, "the opening" should read –the ducts--.

Signed and Sealed this

Seventeenth Day of November, 1998

Bruce Lehman

*Attest:*

BRUCE LEHMAN

*Attesting Officer*

*Commissioner of Patents and Trademarks*